US005318467A

United States Patent [19]

McIntyre

[11] Patent Number: 5,318,467

[45] Date of Patent: Jun. 7, 1994

[54] BODY BOARD

[76] Inventor: Jonothon M. W. McIntyre, 6733 Hinds Ave., North Hollywood, Calif. 91606

[21] Appl. No.: 36,112

[22] Filed: Mar. 22, 1993

[51] Int. Cl.[5] ..... B63B 35/79

[52] U.S. Cl. ..... 441/65; 441/74; 441/79

[58] Field of Search ..... 441/65, 74, 79; 114/315

[56] References Cited

U.S. PATENT DOCUMENTS

| | | | |
|---|---|---|---|
| D. 323,371 | 1/1992 | Ohtaka | D21/236 |
| 1,278,090 | 9/1918 | Barringer | 114/315 |
| 3,491,997 | 1/1970 | Winters | 441/65 |
| 4,302,860 | 12/1981 | Puch | 441/65 |
| 4,886,476 | 12/1989 | Brocone et al. | 441/65 |
| 5,007,871 | 4/1991 | Dyer | 441/65 |

FOREIGN PATENT DOCUMENTS

| | | | |
|---|---|---|---|
| 0113128 | 2/1969 | Denmark | 114/315 |

*Primary Examiner*—Sherman Basinger
*Attorney, Agent, or Firm*—Kelly, Bauersfeld & Lowry

[57] ABSTRACT

A body board for wave surfing includes a shark-shaped semi-rigid board having a pair of depending pectoral fins. The underside of the board is concave, and the board has a cone-shaped nose section with an underside including a series of laterally inboard projecting slats which open and close in response to movement of the fins. A tail section stabilizes the board in the water and provides a seat for the surfer while waiting for or traveling to a wave. The fins each include a sleeve adapted to receive the surfer's hands.

18 Claims, 2 Drawing Sheets

FIG. 4
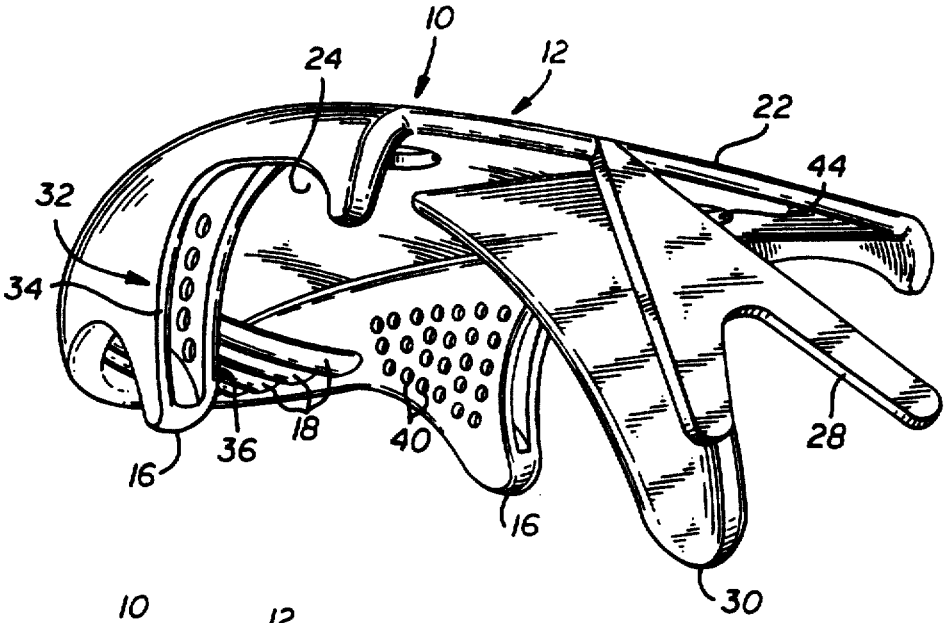
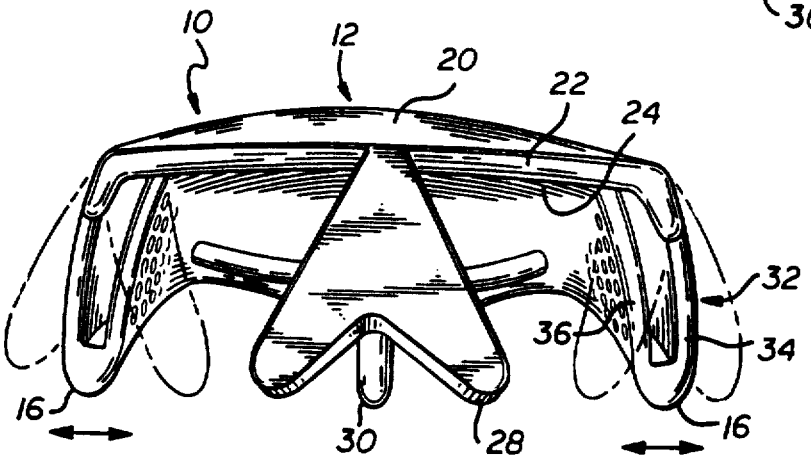
FIG. 5
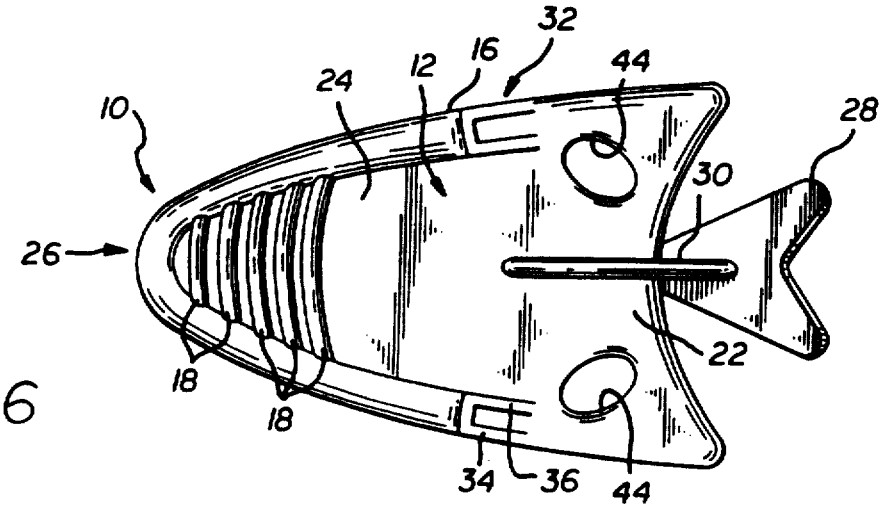
FIG. 6

BODY BOARD

FIELD OF THE INVENTION

This invention relates generally to aquatic sporting goods. More specifically, this invention relates to a body board for prone surfing.

BACKGROUND OF THE INVENTION

The sport of riding a wave toward shore, i.e. surfing, has long been a popular pastime for some and a full-time obsession for others. Competitive surfing has grown into a large industry with its participants traveling the globe to take advantage of regional swell conditions. A surfing subculture has developed which has been featured in several movies and television series.

The surfing method of choice has varied depending on a surfer's experience, swell conditions, budget, etc. Body surfing is favored by some, wherein the fully-extended body itself is propelled by the wave. Body surfing is relatively easy to learn and is most popular among those who don't want to invest the time required to learn other methods, or invest the money into surfing paraphernalia. It is especially popular among those who don't surf on a regular basis.

Boogie boarding has also become popular with the recreational or casual surfer. Boogie boards are typically short rigid boards on which the surfer lies prone and holds onto the board while riding the wave.

The most advanced form of surfing is stand-up surfing done on a long, narrow and somewhat rounded board known as a surfboard. It offers a challenge to the surfer who must manipulate, maneuver, and stabilize the relatively large board while standing on it even in steep or tight turns with the wave crashing around the surfer. While waiting for or moving to the wave, the surfer sits or kneels on the surfboard while paddling, often resulting in a condition known as surfer's knobs. Surfer's knobs are tumorlike overgrowths of connective tissue just below the knees, on the tops of the feet, and often on the toes.

Body surfing, boogie boarding and traditional surfing all rely on the forces generated by a wave to propel a relatively flat, rigid object through the water. There is, therefore, a need for an improved body board which is constructed to efficiently utilize the forces generated by beach waves and provides the surfer with greater control of his or her movement within the wave than that afforded by prior surfing techniques. Such an improved body board should be capable of riding smoothly, be comfortable to paddle and sit on, and appeal to the novice while still posing a challenge to the experienced surfer. The present invention fulfills these needs and provides other related advantages.

SUMMARY OF THE INVENTION

The present invention resides in an improved body board for riding a wave, which is easy to control and master, lightweight and buoyant, rides smoothly, and is comfortable to sit on. The body board comprises, generally, a board on which the surfer is prone while riding the wave, and propulsion means for controlling the speed of the board as it travels through the water. The board may also include a rudder.

In a preferred form of the invention, a relatively easily controlled body board for prone surfing is provided which includes a shark-shaped, semi-rigid, substantially horizontally and longitudinally rounded board with a pair of pectoral fins. The fins form movable winglike extensions which project downwardly and rearwardly from the rounded board. The underside of the board is concave. The board defines a cone-shaped nose section and a forked tail section to stabilize the board and to provide a seat for the surfer while waiting for a wave.

The fins are of sufficient thickness to include a sleeve adapted to receive the surfer's arm. A trunk of the board includes openings aft of the fins to receive the surfer's arms and enable the surfer to extend his arms therethrough and into the respective fin sleeve. An inner surface of each fin defines a plurality of openings adapted to receive the surfer's fingers.

The propulsion means includes a series of slats or gills projecting in a laterally inboard direction in the underside of the nose section. Water passes through and around these slats to propel the body board forward.

When the fins are flexed toward each other by the surfer exerting force with his arms in the fin sleeves the nose section slats open and the board moves forward. The nose section becomes more cone-shaped and water becomes displaced resulting in increased surfing speed. As the fins are extended laterally outward, the nose section slats close minimizing the flow of displaced water and thus slowing down the board. The fins can also be moved independently of one another to assist in controlling the direction of the board through the water.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 4 is another perspective view of the body board shown in FIGS. 1–3, illustrating the concave underside of the board with a plurality of nose section slats and a pair of fin sleeves;

FIG. 5 is a rear elevational view of the body board, illustrating movement of the fins as shown by the arrows; and FIG. 6 is a bottom plan view of the body board, illustrating the plurality of slats in the underside of the nose section and a pair of openings in a trunk of the board aft of the fins through which the surfer's arms extend to be received by the fin sleeves.

DETAILED DESCRIPTION OF THE PREFERRED EMBODIMENT

Figure 1:
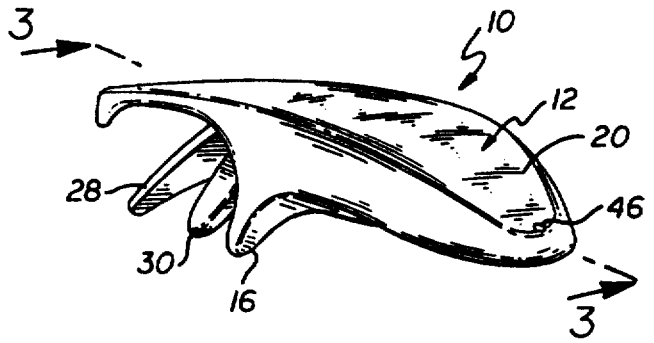
FIG. 1 is a top, front and right side perspective view of a body board embodying the invention, illustrating the shark-shaped appearance of the board.

As shown in the drawings for purposes of illustration, the present invention is concerned with a body board which is generally designated in the accompanying drawings by the reference number 10. In accordance with the present invention, the body board 10 comprises, a board 12 on which the surfer's body 14 lies prone while riding a wave toward shore, a pair of fins 16 extending below the board 12, and a plurality of slats 18 or gills through and around which water passes to propel the body board forward.

The board 12 is illustrated as including a shark-shaped body having a top side 20 with a substantially horizontally and vertically rounded trunk 22 and a concave underside 24. The board defines a cone-shape nose section 26 and a rigid forked tail section 28. The board may also include a rudder 30.

The board 12 is preferably constructed of a semi-rigid, stiff material which is relatively lightweight and buoyant. One such material is closed-cell polyethylene. The board 12 may be one molded piece or several pieces which are subsequently snapped together as one board. A body board capable of disassembly has the advantage of being easily transported, for example, in a car.

The board 12 also defines a pair of movable pectoral fins 16 forming winglike downwardly and rearwardly projecting extensions. The fins 16 move inwardly and outwardly, and are of sufficient thickness to include a sleeve 32 between outer and inner surfaces 34 and 36 thereof. The sleeves 32 are adapted to receive the surfer's arms 38. The inner surface 36 of each fin 16 defines a plurality of uniform circular openings 40 adapted to receive the surfer's fingers 42. The surfer should select those openings which provide the most comfort. The trunk 22 may further include openings 44 aft of the fins 16 to receive the surfer's arms 38 and enable the surfer to extend his arms through the board 12 and into the respective fin sleeve 32.

The nose section 26 is tapered forward and downwardly. The underside of the nose section 26 defines the slats 18 or gills through and around which water passes to move the body board 10 through the water. The thin slats 18 project in a laterally inboard direction from one side to the other. When the fins 16 are moved inwardly toward each other by the surfer exerting force with his arms 38 in the fin sleeves 32, the nose section slats 18 open. The nose section 26 becomes more cone-shaped and water becomes displaced resulting in increased surfing speed. As the fins 16 are extended laterally outward, the slats 18 close to minimize the flow of displaced water and thus slow down the board. The fins 16 are also moved independently of one another to control the direction of the board. If the surfer wants to move the board to the left, for example, the left fin is moved inwardly.

The nose section 26 also includes an air hole 46 to permit air to escape when the board is nose downward in the wave. This same hole may also serve as a cord attachment area for securing the board to the surfer's wrist or ankle.

The rudder 30 extends downwardly from the tail section 28 of the board 12 to remain in the water at all times and assist in controlling the direction of the board. The tail section 28 may be unitary with the trunk 22 of the body board 10 or it may be a distinct appendage. The tail section 28 extends from the center rear of the body board trunk 22 and projects slightly downwardly. The tail section 28 acts both as a stabilizer and as a seat for the surfer while floating or paddling on the water surface waiting for the next wave. The surfer is thus able to avoid having to tread too much water and is also able to alleviate the problem of surfer's knobs.

Figure 2:
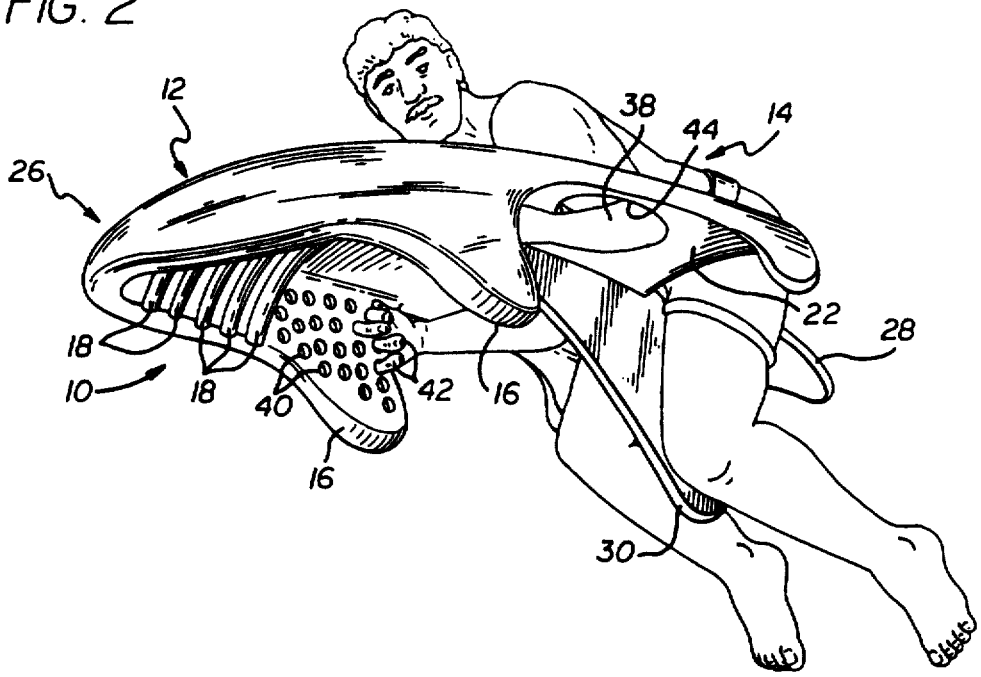
FIG. 2 is a bottom and left side perspective view of the body board shown in FIG. 1, illustrating a surfer in a seated, prone position on a tail section.
Figure 3:
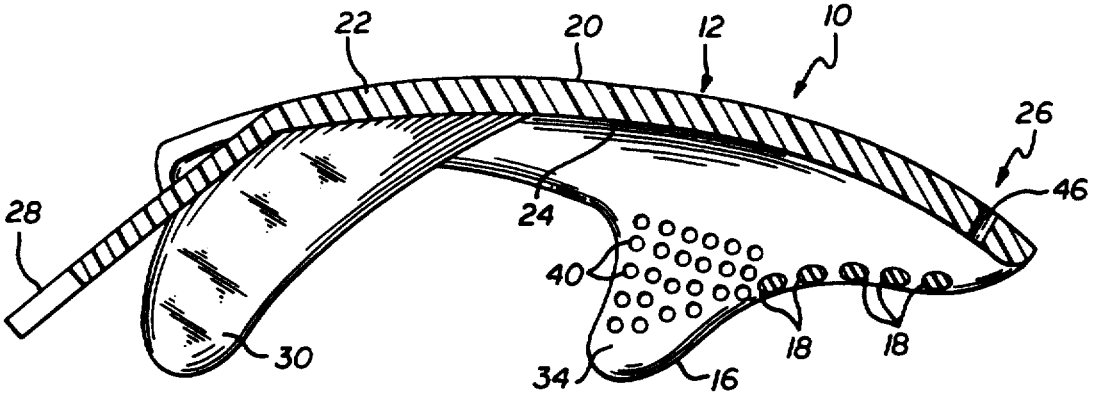
FIG. 3 is a vertical section of the body board taken generally along the line 3—3 of FIG. 1.

While waiting for a wave in the seated position, the surfer's legs straddle the tail section 28. The knees are typically crouched along either side of the rudder 30, and the surfer's body should be on top of the board 12. As shown in FIG. 2, the surfer extends his arms 38 through the openings 44 in the trunk 22 into the fin sleeves 32, and the fingers 42 engage the openings 40 which are the most comfortable for him. At the same time, his upper and lower torso find placement on the board trunk. In the riding position, the surfer's legs extend astride each side of the tail section 28 in a planar relationship to the board. The tail section 28 of the board 12 permits positioning such that the seat is in the middle and the limbs may extend freely. In so positioning the body, the surfer is able to manipulate the improved body board 10 in and around the waves with sufficient control to stabilize the board in steep or tight turns, which makes the board appealing to both the novice and advanced surfer.

Although a particular embodiment of the invention has been described in detail for purposes of illustration, various modifications may be made without departing from the spirit and scope of the invention. Accordingly, the invention is not to be limited, except as by the appended claims.

I claim:

1. A body board for wave surfing, comprising:

a resiliently flexible board having a pair of moveable pectoral fins and a nose section; and propulsion means for controlling the speed of the board as it travels through a wave, including a series of laterally inboard directed slats in the underside of the nose section which open and close as a result of movement of the fins.

2. The body board of claim 1, wherein said board has a top side with a substantially horizontally and vertically rounded trunk, and a concave underside.

3. The body board of claim 1, wherein said nose section includes a cone-shape to provide for facedown forward movement of the board through the wave.

4. The body board of claim 3, wherein said nose section further includes an air escape hole.

5. The body board of claim 1, wherein the slats open when the fins are moved inwardly toward each other.

6. The body board of claim 1, wherein the fins move independently of each other.

7. The body board of claim 1, wherein said fins form winglike downwardly and rearwardly projecting extensions of sufficient thickness to include a sleeve between inner and outer surfaces thereof.

8. The body board of claim 7, wherein said fin inner surface includes a plurality of openings.

9. The body board of claim 8, wherein said sleeves are adapted to receive the surfer's arms and said openings are adapted to receive the surfer's fingers for movement of the fins.

10. The body board of claim 1, wherein said board includes a forked tail section which projects slightly downwardly relative to the board to act as a stabilizer and as a seat.

11. A surfboard, comprising:

a shark-shaped resiliently flexible board having a top side with a substantially horizontal and vertically rounded trunk on which the surfer lies prone while surfing, and a concave underside;

a cone-shaped nose section defined by said board having a series of laterally inboard directed slats in the underside thereof;

a pair of pectoral fins depending from the board which move inwardly and outwardly for opening and closing said slats; and a tail section extending rearwardly from said board.

12. The surfboard of claim 11, wherein said tail section projects slightly downwardly from the board to act as a stabilizer and as a seat.

13. The surfboard of claim 11, wherein said moveable fins form winglike downwardly and rearwardly projecting extensions from the board of sufficient thickness to include a sleeve between an inner and an outer surface thereof, said inner surface including a plurality of openings therethrough.

14. The surfboard of claim 11, including a rudder extending downwardly and rearwardly from the board.

15. The surfboard of claim 14, wherein the rudder is attached to and forms a portion of the tail section.

16. A body board for wave surfing, comprising:

a resiliently flexible board having a generally conical nose section and a rearwardly extending trunk;

a pair of pectoral fins depending downwardly from the board and moveable inwardly and outwardly relative to the board;

a tail section extending rearwardly from the trunk of the board, the tail section providing a seat for a surfer; and propulsion means for controlling the speed of the board as it travels through a wave, including a plurality of laterally extending slats forming an underside of the nose section, which slats move as a result of movement of the fins.

17. The body board of claim 16, wherein the fins each include a sleeve for receiving the hand of a surfer therein.

18. The body board of claim 15, wherein the tail section includes a rudder extending below the seat and attached to an undersurface of the trunk of the board.

* * * * *

UNITED STATES PATENT AND TRADEMARK OFFICE

CERTIFICATE OF CORRECTION

PATENT NO. : 5,318,467

DATED : June 7, 1994

INVENTOR(S) : Jonothon M.W. McIntyre

It is certified that error appears in the above-identified patent and that said Letters Patent is hereby corrected as shown below:

In column 6, line 17, delete "15" and insert --17--.

Signed and Sealed this

Fourth Day of October, 1994

*Attest:*

*Attesting Officer*

BRUCE LEHMAN

*Commissioner of Patents and Trademarks*